United States Patent [19]

Müller et al.

[11] Patent Number: 4,619,589

[45] Date of Patent: Oct. 28, 1986

[54] DIAPHRAGM PUMP, PARTICULARLY FOR DOSING LIQUIDS

[75] Inventors: Klaus Müller, Karlsruhe; Sieghard Oberacker, Dettenheim, both of Fed. Rep. of Germany

[73] Assignee: Alldos Eichler KG, Pfinztal, Fed. Rep. of Germany

[21] Appl. No.: 767,618

[22] Filed: Aug. 20, 1985

[30] Foreign Application Priority Data

Aug. 21, 1984 [DE] Fed. Rep. of Germany ..... 3430721

[51] Int. Cl.[4] ..... F04B 43/06

[52] U.S. Cl. ..... 417/388

[58] Field of Search ..... 417/383, 386, 387, 388

[56] References Cited

U.S. PATENT DOCUMENTS

| | | | |
|---|---|---|---|
| 2,303,597 | 12/1942 | Adelson | 417/386 X |
| 2,993,446 | 7/1961 | Pleuger | 417/383 X |
| 3,902,826 | 9/1975 | Nagel et al. | 417/388 X |
| 3,957,399 | 5/1976 | Siczek | 417/387 |

FOREIGN PATENT DOCUMENTS

| | | | |
|---|---|---|---|
| 2333876 | 1/1975 | Fed. Rep. of Germany | 417/388 |

*Primary Examiner*—Leonard E. Smith

*Attorney, Agent, or Firm*—Antonelli, Terry & Wands

[57] ABSTRACT

In the case of a diaphragm pump, as is more particularly used for dosing or metering liquids and which is provided on the one hand with a dosing chamber with a suction and pressure valve and on the other with a hydraulic working chamber with drive piston and pressure relief valve, both chambers being separated by the working diaphragm, an effective diaphragm protection against excessive deflection and consequently overstressing is obtained in that the diaphragm defines a chamber connected to the working chamber by means of at least one overflow channel and in the vicinity of the overflow channel is guided a valve unit comprising a tappet with in each case one valve disk for the facing openings of the overflow channel and which is in operative connection with the diaphragm.

10 Claims, 4 Drawing Figures

DIAPHRAGM PUMP, PARTICULARLY FOR DOSING LIQUIDS

BACKGROUND OF THE INVENTION

The invention relates to a diaphragm pump, particularly for dosing or metering liquids with a diaphragm defining a dosing chamber with a suction and pressure valve on one side and a hydraulic working chamber with drive piston and pressure relief valve on the other.

Diaphragm pumps of this type, which are also known as piston diaphragm pumps, are known in various different constructional forms. The operating principle thereof is that the elastically deformable diaphragm performs its stroke in the working chamber under varying hydraulic pressure in which during the suction stroke in which it enlarges the dosing chamber, it sucks in the liquid to be delivered by means of the suction valve and during the pressure stroke during which it moves into the dosing chamber forces the same out by means of the pressure valve. The pressure change in the working chamber is produced by a piston which closes the same and which is operated by an oscillating drive, e.g. a cam.

Since as a result of the elasticity required of it and the necessary working stroke, the diaphragm has a comparatively limited wall thickness, it is sensitive to overstressing. Such an overstressing can e.g. occur in the case of an excessive suction lift or in the case of a closed or blocked suction line, but also with leaks in the suction or pressure valve. It leads to the diaphragm becoming overstretched and is optionally permanently deformed and in the extreme case even tears. Thus, not only does the diaphragm pump stop operating, but it is also possible for mixing of hydraulic working medium and dosing medium to take place, which leads to corresponding damage.

To avoid excessive deflection of the diaphragm and the resulting risks, separate support means are provided, which limit the diaphragm stroke. These support means generally comprise cup-shaped disks, which are provided with a plurality of channels so that, as a function of the arrangement of the support means, the passage of the working or dosing medium is possible. In the case of a maximum stroke, the diaphragm engages on the cup. Here again damage can occur, in that in the case of an excessively high pressure difference, the diaphragm can be deformed into the channels, so that there are once again permanent deformations or even cracks.

SUMMARY OF THE INVENTION

The problem of the present invention is to provide a diaphragm pump, which is provided with a functionally reliable diaphragm protection, which effectively prevents any overloading.

On the basis of a diaphragm pump of the aforementioned construction, this problem is solved in that the diaphragm bounds a chamber connected to the working chamber by means of at least one overflow channel, that in the vicinity of the overflow channel is guided a tappet with in each case a valve disk for the facing openings of the overflow channel and that the valve unit formed from the tappet and the valve disks is in operative connection with the diaphragm.

The diaphragm protection according to the invention functions as follows. In normal dosing operation, in which the diaphragm is moved backwards and forwards by the hydraulic working medium, the tappet follows this movement with the valve unit, so that the working medium passes out of the working chamber via the overflow channels into the said chamber and at the back appears at the diaphragm. The reciprocal spacing of the valve disks or the spacing thereof from the facing openings of the overflow channels is dimensioned in such a way that at least during the pressure stroke, the valve unit does not pass into the closed position, because otherwise the discharge capacity would be impaired. Only if the diaphragm is deflected in one or other direction beyond the maximum stroke, as a function of the deflection direction, one or other valve disk passes into the closed position, so that the chamber and consequently the diaphragm is disengaged from the working medium, so that no further pressure reduction can take place. Thus, unlike in the relevant Prior Art, the diaphragm is not kept in its limiting positions by mechanical support means and instead the invention provides an active diaphragm protection on the hydraulic side, so that no overstressing is possible. This diaphragm protection functions absolutely reliably in any operating situation.

Preferably the valve unit engages with the diaphragm under the action of a weak spring tension, which is advantageously made so small that it makes no active contribution to the diaphragm deflection. In the case of hydraulic equilibrium on either side of the diaphragm, the spring tension merely serves to overcome the frictional forces of the tappet guidance and the inertia forces of the system, i.e. during the pressure stroke always ensures that the valve unit engages on the diaphragm. However, during the suction stroke it offers no or no significant resistance to the diaphragm movement.

In place of the loose engagement of the valve unit on the diaphragm, these two components can also be positively interconnected.

According to an embodiment, between the chamber and the hydraulic working chamber an insert is provided, in which on one side the tappet is guided and on the other the overflow channel is arranged. The insert preferably contains a plurality of overflow channels surrounding the tappet or its guide, whose opposite openings on either side of the partition are closable in each case one of the valve disks. Thus, each valve disk covers all the openings on one side of the overflow channels.

According to a particularly advantageous construction, a bevel seat is formed on either side of the insert and its small diameter roughly corresponds to the diameter of the external enveloping circle of the openings of the overflow channels. Thus, a single central sealing face is formed for all the overflow channels. Advantageously in this construction, the valve disks also have a bevel face as the sealing face.

According to another embodiment the spring producing the spring tension is arranged between the two valve disks and is supported on the one hand within the insert and on the other on the valve disk facing the diaphragm.

In another embodiment the spring tension can be produced by a helical spring surrounding the tappet and supported on the one hand on the support disk and on the other on the insert side opposite to the same.

As a result of the inventive construction of the diaphragm protection, which prevents overstressing or damage to the diaphragm even under extreme operating conditions, it is possible to use a very thin-walled diaphragm and consequently one which is made from plastic, particularly PTFE. On the one hand this makes it possible to convey highly corrosive media, which was hitherto not possible or could only take place by using very expensive composite materials, whilst on the other hand achieving relatively high pressures, which are not limited by the diaphragm strength.

BRIEF DESCRIPTION OF THE DRAWINGS

The invention is described in greater detail hereinafter relative to non-limitative embodiments and the attached drawings.

DETAILED DESCRIPTION OF THE PREFERRED EMBODIMENTS

Figure 1:
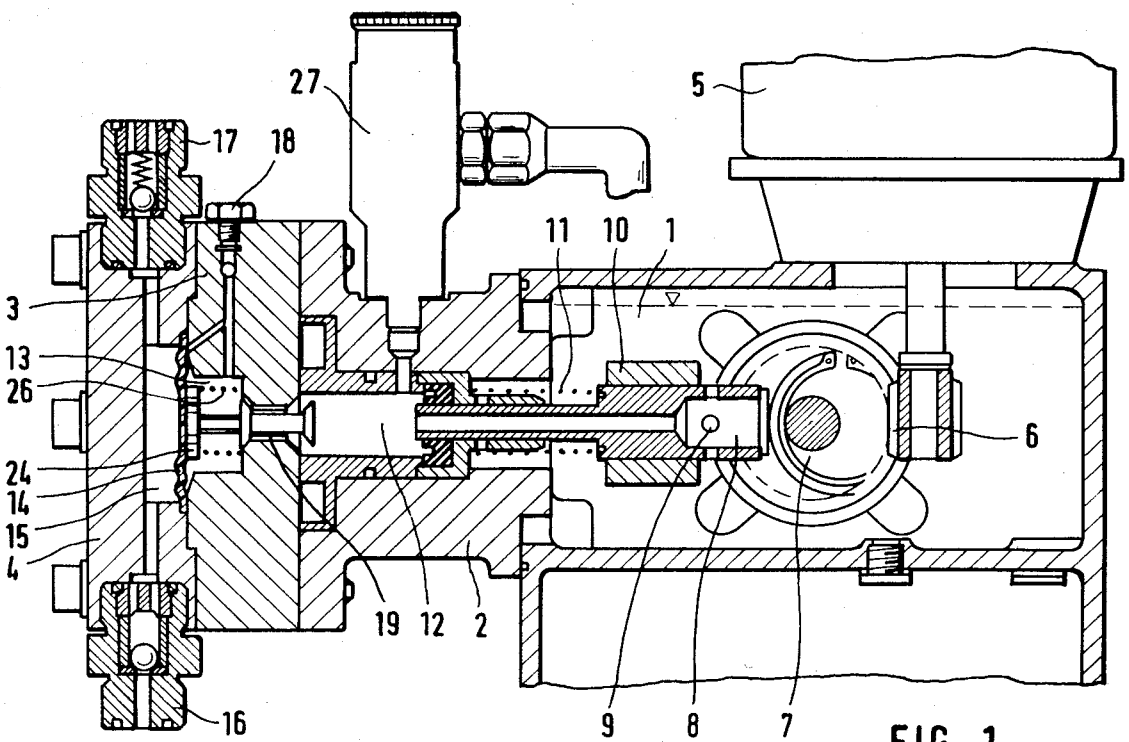
FIG. 1 A section through an embodiment of a diaphragm pump.

The diaphragm pump according to FIG. 1 has a multipart casing, which comprises a hydraulic working medium tank 1, a piston casing 2, a valve head 3 and a dosing head 4, which are fitted in axial succession. The tank 1 carries a drive motor 5 with a worm gear 6, which drives a cam 7, which acts on a hollow piston 8, guided in piston casing 2, and being provided in the vicinity of its drive side with a cross-bore 9 for the passage of the hydraulic medium from tank 1 into the piston cavity. In the vicinity of the drive side, piston 8 is also overlapped by a control slide valve 10 which, as a start control, makes it possible to adjust the working stroke. Finally, piston 8 is under the action of a spring 11, which keeps it engaged with cam 7. The cavity of piston 8 and the area 12 upstream thereof in piston casing 2 and a chamber 13 in valve head 3 form the working chamber of the dosing pump, area 12 being connected by means of a pressure relief valve 27 to tank 1.

The chamber 13 is frontally defined by the dosing diaphragm 14, which simultaneously forms the rear closure of dosing chamber 15. The latter is connected by means of a suction valve with the medium to be conveyed and also has a pressure valve 17. Finally, chamber 13 is also equipped with a vent valve 18.

Figure 2:
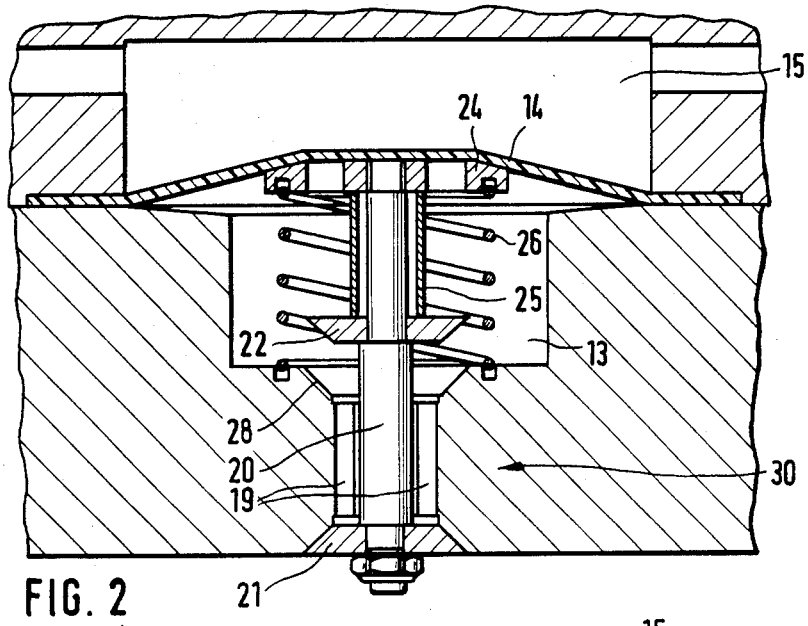
FIG. 2 A larger-scale detail of the valve unit in one limiting position.
Figure 3:
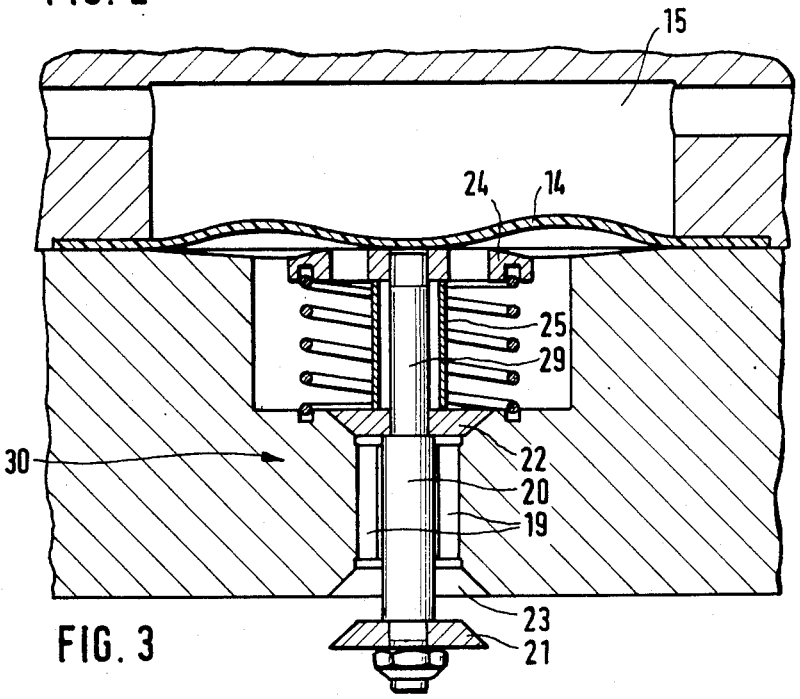
FIG. 3 The valve unit according to FIG. 1 in the other limiting position.

Between chambers 12 and 13 a plurality of overflow channels 19 are concentrically arranged about a common axis in a partition formed by valve head 3, cf particularly FIGS. 2 and 3. A tappet 20 is guided equiaxially within the valve head and is concentrically surrounded in the vicinity of the guide by the overflow channels 19. On either side of the partition formed by valve head 3, tappet 20 is provided with in each case one valve disk 21, 22, which cooperate with a corresponding bevel seat 23 or 28, which is formed in the partition and which widen the overflow channels 19 to the outside. Tappet 20 with valve disks 21, 22 and bevel seats 23, 28 form the valve unit 30 used for the protection of diaphragm 14.

In the represented embodiment tappet 20 is provided at the end facing valve disk 21 with a shoulder 29 having a support disk 24, which is supported via a spacer bushing 25 on the other valve disk 22. Under the action of a spring 26, which is supported on the wall of chamber 13, support disk 24 engages loosely on diaphragm 14.

FIG. 2 shows the extreme position of diaphragm 14 during the pressure stroke, in which the valve disk 21 closes the overflow channels 19 with respect to the working chamber 12 of piston 8, whilst FIG. 3 shows the other limiting position during the suction stroke, in which the valve disk 21 closes the overflow channels 19. In both limiting positions the diaphragm is consequently hydraulically disengaged from the working chamber, so that it can be loaded over and beyond the limiting positions.

Figure 4:
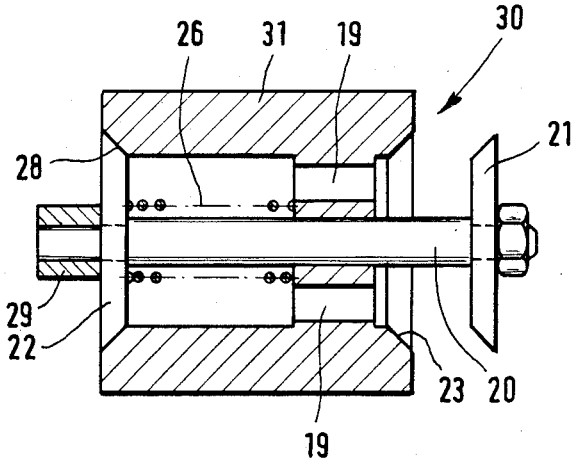
FIG. 4 A section through another embodiment of the valve unit.

FIG. 4 shows a modified embodiment of the valve unit, which in particular has manufacturing and fitting advantages. It once again has a tappet 20, to each of whose ends is fixed a valve disk 21, 22, which once again cooperate with the bevel seats 23, 28. Bevel seats 23, 28 and overflow channels 19 are arranged on an insert 31, which is once again tightly inserted in valve head 3 (FIG. 1). Between the overflow channels 19 and the valve disk 22 facing diaphragm 14 (FIG. 1) is provided a larger diameter bore, in which is arranged spring 26, which is supported on the one hand in insert 31 and on the other on valve disk 22, so that it moves valve unit 30 in the direction of diaphragm 14.

What is claimed is:

1. A diaphragm pump, particularly for dosing liquid, comprising a diaphragm arranged in a housing, a dosing chamber with a suction and a pressure valve on one side of the diaphragm, a hydraulic working chamber with a drive piston and a pressure relief valve on the other side of the diaphragm, a chamber arranged between the diaphragm and hydraulic working chamber, at least one overflow channel connecting the chamber with the hydraulic working chamber, a valve unit including a tappet with a valve disk at each end thereof facing openings of the at least one overflow channel into the chamber and hydraulic working chamber and movable alternately to close with one valve disk the opening into the chamber and with the other valve disk the opening into the hydraulic working chamber, and the valve unit being operatively connected with the diaphragm by means of a support disk and a light loading spring which urges the support disk into loose engagement with the diaphragm.

2. A diaphragm pump according to claim 1, wherein the spring is loaded such that, when hydraulic equilibrium exists on both sides of the diaphragm, the spring load merely overcomes inertia forces and frictional forces of the valve unit.

3. A diaphragm pump according to claim 1, wherein the support disk includes an elongated portion extending through the chamber.

4. A diaphragm pump according to claim 1, wherein an insert is provided between the chamber and the hydraulic working chamber, the at least one overflow channel being provided in the insert, and the tappet being guidably movable in the insert.

5. A diaphragm pump according to claim 4, wherein the insert contains a plurality of overflow channels surrounding the tappet, the channels having openings on sides of the insert facing the chamber and the hydraulic working chamber adapted to be alternately closed with the valve disks of the valve unit.

6. A diaphragm pump according to claim 5, wherein a bevel seat is provided at each of the sides of the insert facing the chamber and the hydraulic working chamber, each bevel seat having a small diameter approximating a diameter defined by an envelope of the openings of the overflow channels.

7. A diaphragm pump according to claim 6, wherein the valve disks are provided with a bevel face corresponding to the bevel seat of the insert.

8. A diaphragm pump according to claim 4, wherein the spring is arranged between the valve disks within the insert so as to have one end acting against the insert and the other end on the valve disk facing the diaphragm.

9. A diaphragm pump according to claim 1, wherein the spring is a helical spring supported at one end on the support disk and at the other end on a wall of the chamber opposite the support disk.

10. A diaphragm pump according to claim 1, wherein the diaphragm is made from plastic.

* * * * *